US008511039B2

(12) United States Patent
Dougall et al.

(10) Patent No.: US 8,511,039 B2
(45) Date of Patent: Aug. 20, 2013

(54) SAFETY BARRIER FOR MULTI-STOREY BUILDINGS

(76) Inventors: Cameron Bruce Dougall, Orillia (CA); Marlous Juan Hess, Thornhill (CA)

( * ) Notice: Subject to any disclaimer, the term of this patent is extended or adjusted under 35 U.S.C. 154(b) by 603 days.

(21) Appl. No.: 11/247,377

(22) Filed: Oct. 12, 2005

(65) Prior Publication Data

US 2007/0094942 A1 May 3, 2007

(51) Int. Cl.

| | |
|---|---|
| ***E04B 1/00*** | (2006.01) |
| ***E04G 21/00*** | (2006.01) |
| ***E04G 23/00*** | (2006.01) |
| ***E04B 5/40*** | (2006.01) |
| *E04B 1/24* | (2006.01) |
| *E04B 1/35* | (2006.01) |
| *E04G 5/14* | (2006.01) |
| *E04G 3/30* | (2006.01) |
| *E04G 7/28* | (2006.01) |

(52) U.S. Cl.

CPC ... *E04B 5/40* (2013.01); *E04B 1/24* (2013.01); *E04B 1/35* (2013.01); *E04G 5/14* (2013.01); *E04G 3/30* (2013.01); *E04G 7/28* (2013.01)

USPC ..... 52/745.05; 52/64; 182/113

(58) Field of Classification Search

USPC ..... 52/745.06, 745.05, 64; 264/33, 264/34; 182/113, 82, 112; 29/248

See application file for complete search history.

(56) References Cited

U.S. PATENT DOCUMENTS

| | | | | | |
|---|---|---|---|---|---|
| 3,881,699 | A | * | 5/1975 | Nusbaum | 256/59 |
| 4,119,176 | A | * | 10/1978 | Verdu | 182/138 |
| 4,129,197 | A | * | 12/1978 | Preston | 182/82 |
| 4,856,615 | A | * | 8/1989 | Nusbaum | 182/82 |
| 4,892,169 | A | * | 1/1990 | Duncan | 182/138 |
| 4,979,725 | A | * | 12/1990 | Hutchings et al. | 256/64 |
| 5,156,235 | A | * | 10/1992 | Preston | 182/186.9 |
| 5,161,641 | A | * | 11/1992 | Nusbaum | 182/138 |

* cited by examiner

*Primary Examiner* — Basil Katcheves
*Assistant Examiner* — Theodore Adamos
(74) *Attorney, Agent, or Firm* — Jean Kyle

(57) ABSTRACT

A safety barrier system for use in constructing multi-storey buildings has elongated safety barrier panels extending upwards from a first floor level a sufficient height to serve as effective safety barriers during the work for the subsequent floor. The panels are supported at their side edges in rails along which the safety barrier panels can slide. The rails are duplexed (siamesed) so as to link the respective safety barrier panels into a continuous peripheral barrier. The respective panels and rails are braced and independently supported, permitting the system elements to be 'walked' piecemeal up the face of a structure as required during its erection. Auxiliary barriers supplement the displaced panels, on lower levels, while toe-boards protect the floor-to-panel gap.

7 Claims, 14 Drawing Sheets

SAFETY BARRIER FOR MULTI-STOREY BUILDINGS

BACKGROUND OF THE INVENTION

1. The present invention is directed to a safety barrier system for buildings, and in particular to a vertically extensible safety barrier for use in the construction of multi-storey buildings.

2. The history of constructing tall buildings is notoriously replete with the associated deaths of workers who fall from such structures. In the case of the Empire State Building in New York City tradition has it that each floor of elevation accounted for the loss of a worker's life.

Present day loss of lives, while not as scandalously high, is nevertheless too great. A common technique for building a high rise building is to erect formwork at ceiling height above an existing floor, lay reinforcement, and then pour concrete into the formwork to form the next floor. The installation of such formwork and reinforcement necessitates working at a highly exposed, poorly protected working level. Protective methods and apparatus currently in use include: low barriers to guard against accidental dislodgement of tools and materials from off the perimeter of the 'working' floor, and to safeguard workers from going beyond the floor perimeter; with peripheral safety nets strung about the perimeter of a lower floor, beneath the current working level and extending out from that floor. Being mounted upon vertical tracks, the nets can be raised, floor by succeeding floor, as the building progresses upwardly, However, while the net may save a life, the support structure for the net itself constitutes a hazard for anyone falling onto it.

When an overlying floor has been poured, support poles may be jacked into place between floor and 'ceiling', from which poles safety fencing may be secured, to restrain both individuals, their tools, and materials from falling. This latter system leaves open a dangerous accident 'window', until the succeeding floor has been poured, and the poles can be installed, which 'windows' constitute the most dangerous times of the building process, when workers are installing formwork and reinforcement while being totally unprotected against falling off the structure.

BRIEF SUMMARY OF THE INVENTION

The present invention provides a safety module having an elongated safety panel that can extend from one floor of a building structure and project upwardly above a superposed higher floor (working level) of the structure by an extent sufficient to constitute an effective safety barrier for that working level. The safety barrier panel is slidably mounted between a pair of side rails, enabling the safety barrier panel to be relocated upwardly, as a building progresses, floor by floor, with the safety bather panel also serving as a guide for the side rails, such that the safety barrier can be "walked" piecemeal up the side of a building, as the building progresses.

Thus, the present invention provides a portable safety barrier panel system for use at the face of a building, including a building under construction, with the distance between one floor and a superimposed floor being a first predetermined value; the safety barrier panel system comprising a plurality of adjoined safety modules, each safety module having a pair of vertical side rails in mutually parallel relation, extending to a second predetermined height; a safety barrier panel having a third predetermined height extending laterally between the side rails and slidably mounted to the side rails for relative vertical displacement relative to the side rails; the second predetermined height exceeding the first predetermined height by substantially at least the third predetermined height, whereby in use, with the module side rails secured to one floor of the building, the side extend upwardly a sufficient distance to enable the safety barrier panel to be elevated, in positioned relation between the side rails, and extending to its third height above the superimposed floor.

The subject system further includes first brackets securable to the floor of the building, in supporting relation with a side rail, to position the side rail in adjacent, outwardly spaced relation from the floor; and braces attachable between the side rails and the building structure to enable the side tracks to be secured in upstanding, cantilevered relation from the brackets, in supporting relation with the safety barrier panel.

The subject system further includes toe boards of restricted depth, laterally coextensive with the safety barrier panel, and bridging a gap between the face of the safety barrier panel and the adjacent edge of the building floor, to contain articles from entering the gap. The subject system may further include safety barriers attachable to a floor inboard of the safety barrier panel system, to prevent unintended movement by an individual towards the subject safety barrier system. The safety barriers may be covered with a mesh to prevent material from falling from the enveloped floor.

The subject system also includes second, intermediate brackets that are attachable to a floor, and to a side rail at a position intermediate its ends. The intermediate brackets are also attachable in supporting relation to the safety barrier panels, enabling the safety barrier panels to be independently secured in a raised location, intermediate the ends of the side rails.

The relative sliding relationship between the safety barrier panel and its side rails enables the safety barrier panel, when anchored to the structure, to serve as a slide guide for its respective side rails, enabling the side rails to be individually moved upwardly, by hand or by mechanical means to a higher floor and re-anchored. Correspondingly, the anchored and braced side rails serve as cantilevered guides for the respective safety barrier panel/panels.

Thus the elements of the system can be "walked" up the face of the building, being repositioned piecemeal as they are individually raised into place.

Further characteristics of the present invention include duplexed side rails, wherein one of the side rails for one module is adjoined with the side rail of an adjacent module, into a unitary structure, thus facilitating coordinated relocation on a building. Also, an anchor bracket is provided for attachment to a selected building floor, the bracket being attachable by bolting or pinning to the duplexed side rails, and to each of the two associated safety barrier panels, independently of the side rails.

The subject anchor bracket is open-faced, enabling the independent vertical relocation of each safety barrier panel and the duplexed side rail track. The safety barrier panels and side rails can be pinned to the anchor brackets at intermediate locations along their lengths. This facilitates securing side rails in upwardly cantilevered relation, projecting up from anchor brackets on two floor levels.

BRIEF DESCRIPTION OF THE SEVERAL VIEWS OF THE DRAWINGS

Certain embodiments of the present invention are presented herewith, by way of illustration, without limitation thereto, other than as set forth in the claims hereof, it being understood that alternative embodiments herefrom may be readily provided by ones skilled in the art, in light of the present disclosure. Reference to the present drawings is made, wherein:

DETAILED DESCRIPTION. OF THE INVENTION

Figure 1:
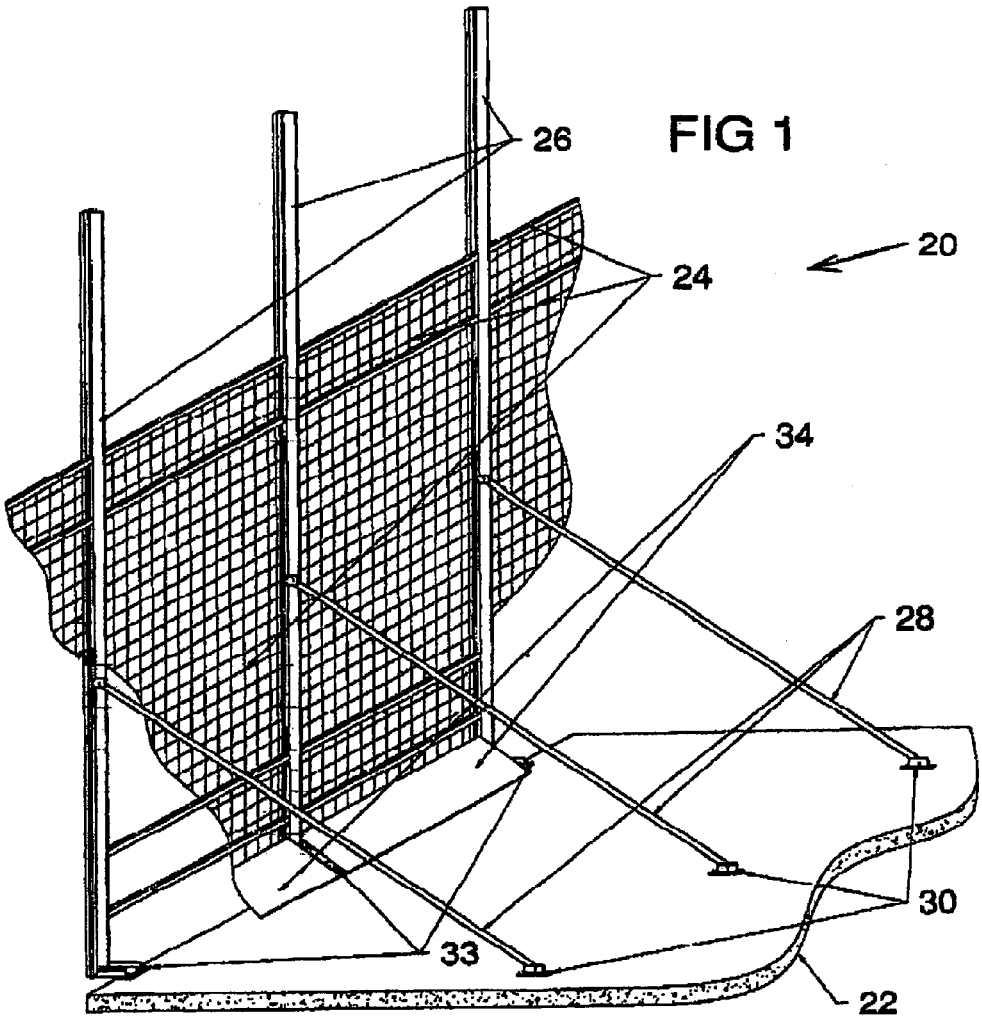
FIG. 1. is a side top perspective of the of a safety barrier in accordance with the present invention mounted to a first completed floor of a building under construction.

Referring to FIG. 1, this shows a side top perspective of the elements of an embodiment of the subject safety barrier system 20, wherein a safety barrier system 20 is shown mounted on a cast concrete floor 22 of a building under construction.

Safety bather panels 24 are slidably supported by side rails 26, of which the proximal side rails 26 are shown. Inclined braces 28 secure the assembly 20 in upstanding cantilevered relation from the poured concrete floor 22, the braces 28 being pinned to the safety barrier panels 24 and to brackets 30 that are screwed to the floor 22.

Figure 2:
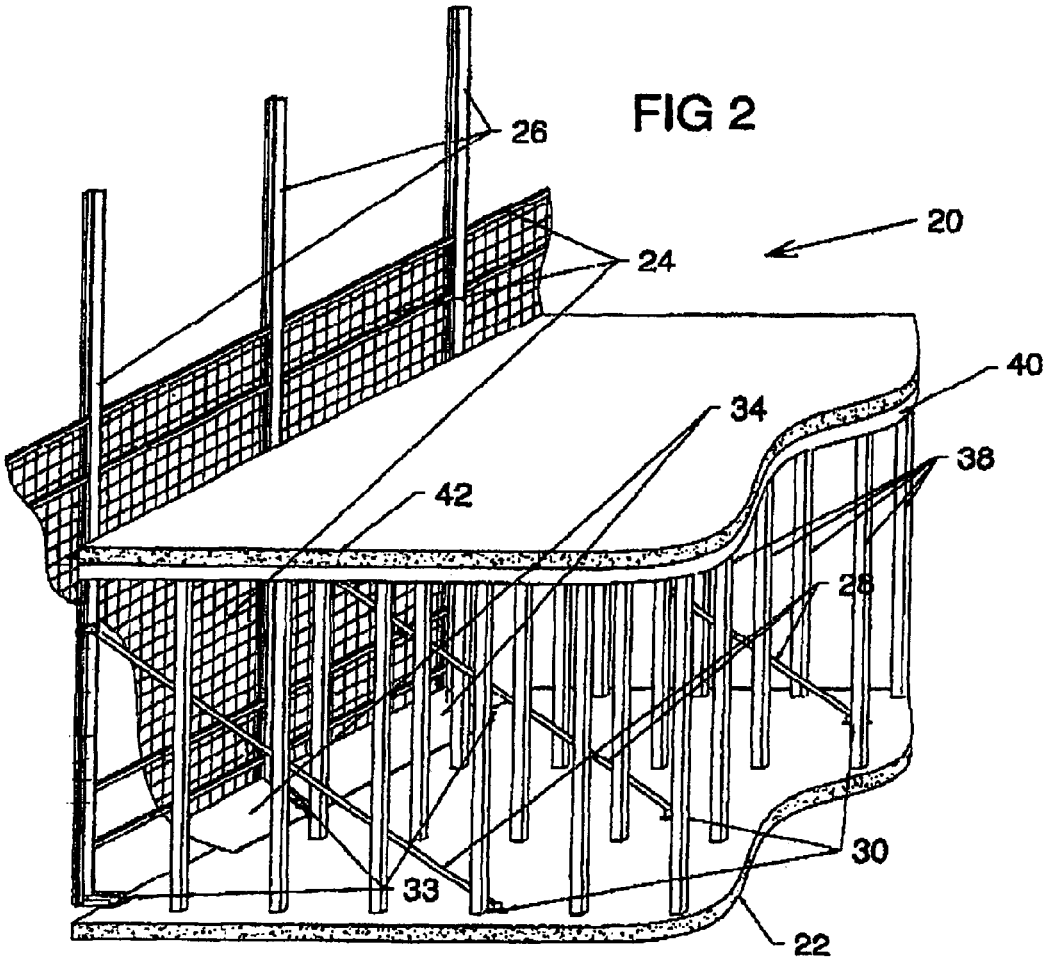
FIG. 2. is a side top perspective of the of the subject barrier mourned to a first completed building floor and extending to a second, superposed building floor.

The lower ends of the side rails 26 are supported by being pinned to multi-bracket 33 at floor 22. The lower ends of the safety bather panels 24 are supported by being pinned to multi-bracket 33, which are bolted to the floor 22. A toe-board 34 which extends laterally coextensive with each safety barrier panel 24, and is attached thereto, serves to bridge the gap between each safety barrier panel 24 and the edge of floor 22. This particularly serves to prevent tools and materials from falling off the floor surface. Turning to FIG. 2, with the elements of safety bather system 20 extending up from floor 22, as illustrated in FIG. 1, concrete formwork members 38, 40 and associated re-bar can be safely installed within the protective ambit of the upwardly projecting top portion of safety fence 24, and the floor 42 then poured within the protective ambit of the upwardly projecting elements of safety barrier panels 24, without risk of workers falling from the edge of the building.

Figure 3:
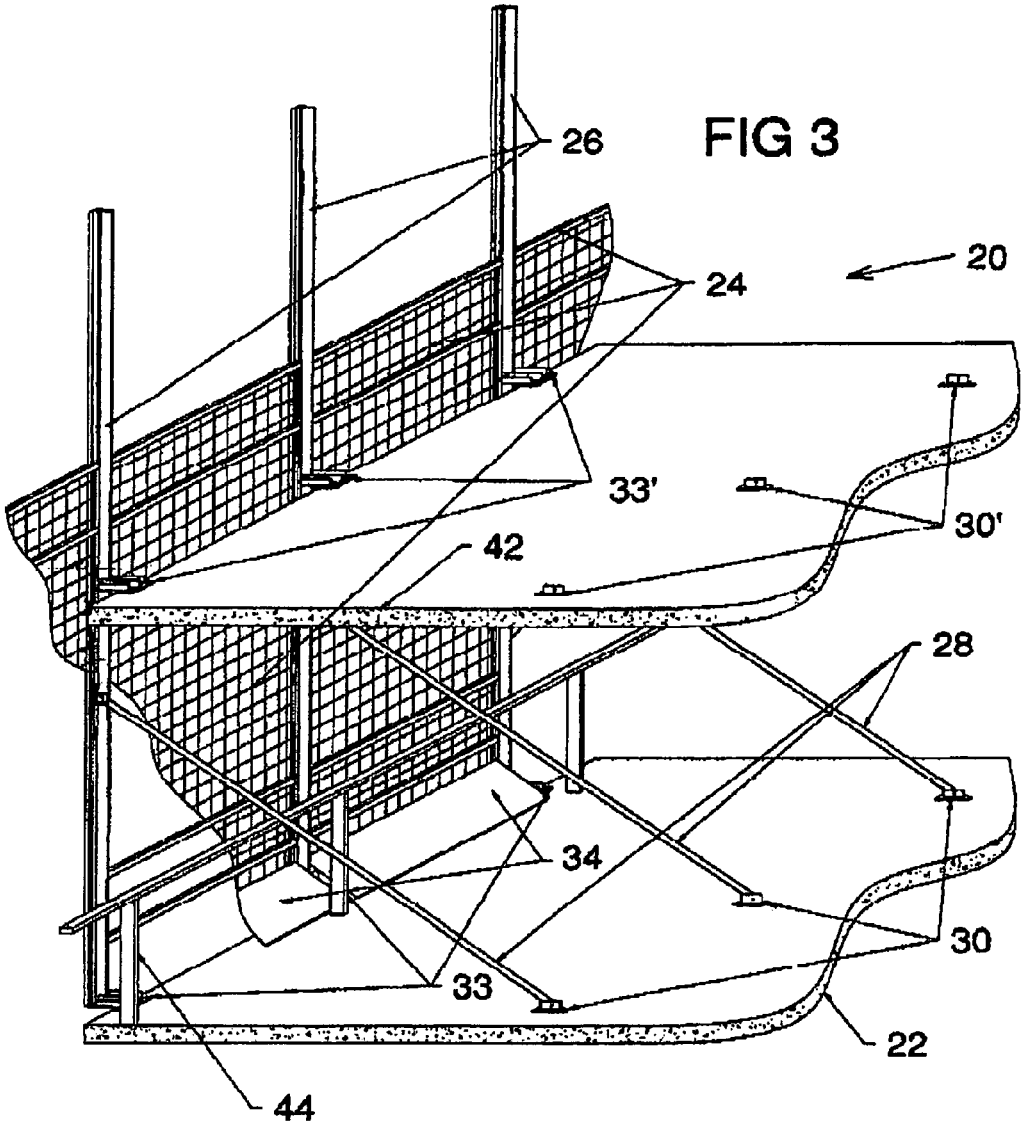
FIG. 3. is a view similar to FIG. 2. with shoring removed, and a guard rail added, and with panels and siderails secured to a superposed floor.

Turning to FIG. 3, temporary conventional guard rail 44 is installed adjacent the edge of the floor, and on the 'new' floor 42, brackets 30' for additional braces 28 and additional multi-brackets 33' are installed, while the formwork 38, 40 is indicated as having been removed.

Figure 4:
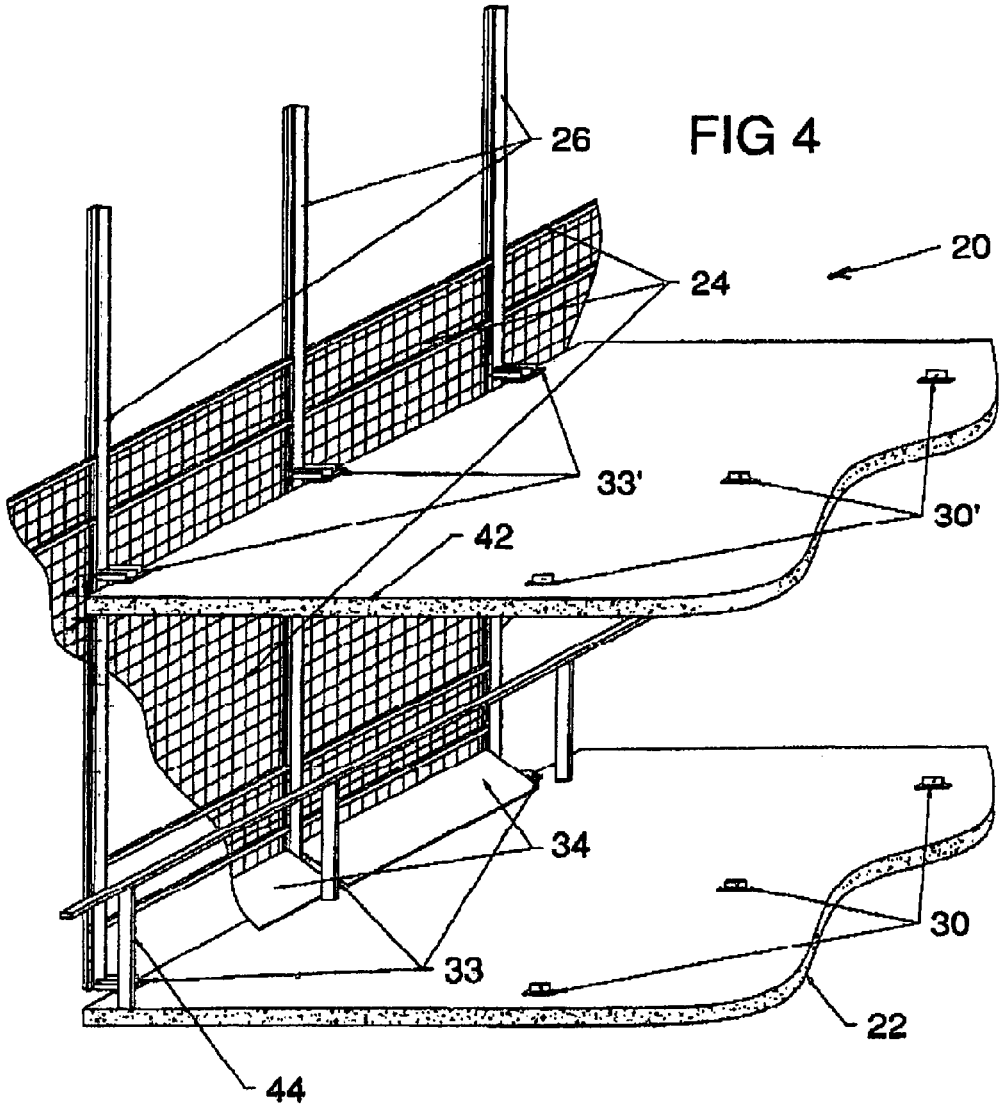
FIG. 4. is a is a view similar, to FIG. 4 showing installation of brackets for future braces on a superposed floor.

FIG. 4, shows that the braces 28 have been removed. The safety barrier panels 24 and side rails 26 are each individually supported by both the multi-brackets 33 at floor 22 and the multi-brackets 33' at floor 42.

Figure 5:
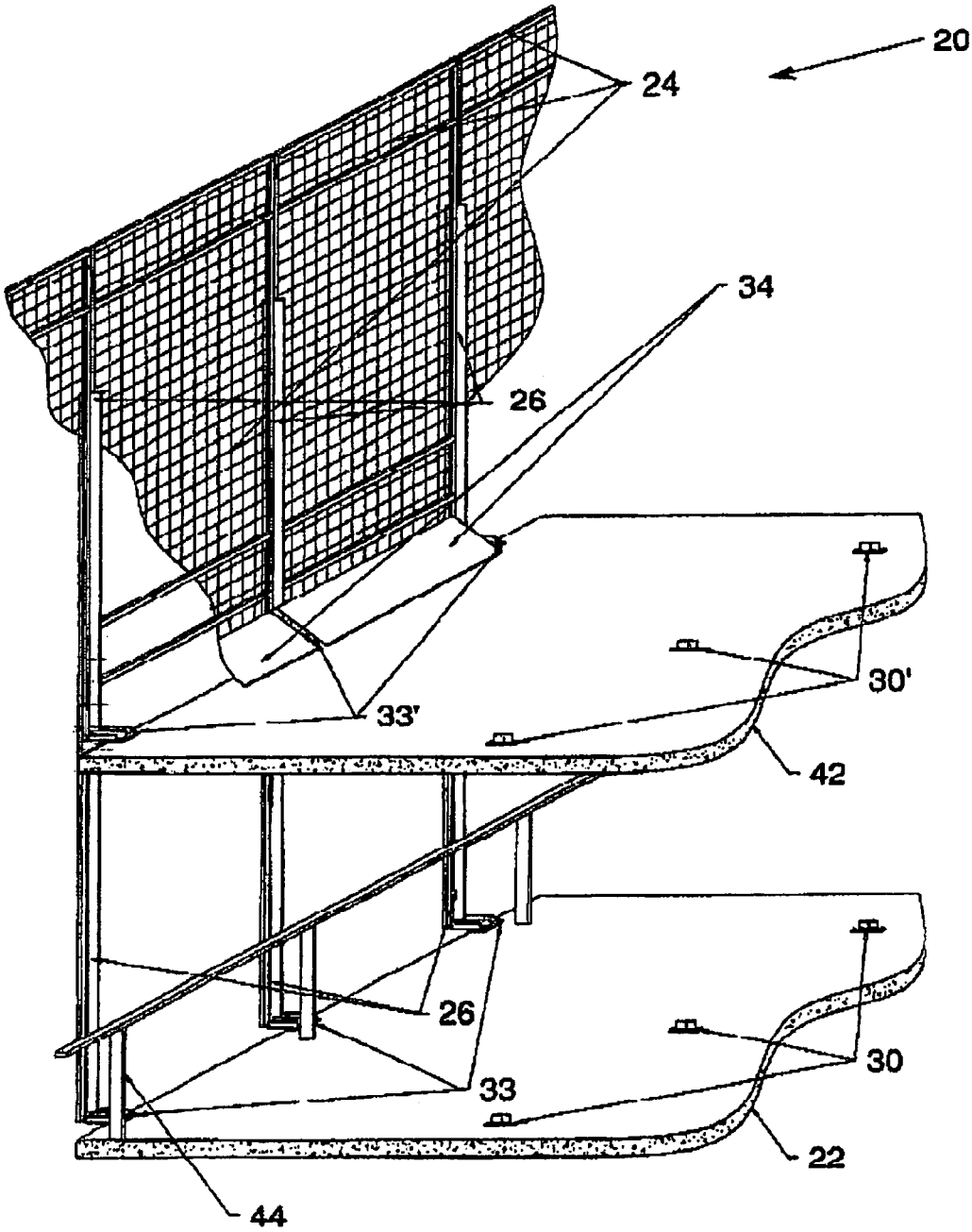
FIG. 5 is a view similar to FIG. 4, showing safety barrier panels raised and secured to a superposed floor.

In FIG. 5, the safety barrier panel 24 is shown to be raised to floor 42, secured by previously installed multi-brackets 33', while slidably engaged in the side rails 26. A temporary conventional guard rail 44 serves to safeguard the opened perimeter of floor 22, the safety barrier panels 24 having been moved from this area. The side rails 26 remain supported by multi-brackets 33 secured to the floor 22 and by multi-brackets 33; secured to floor 42.

Figure 6:
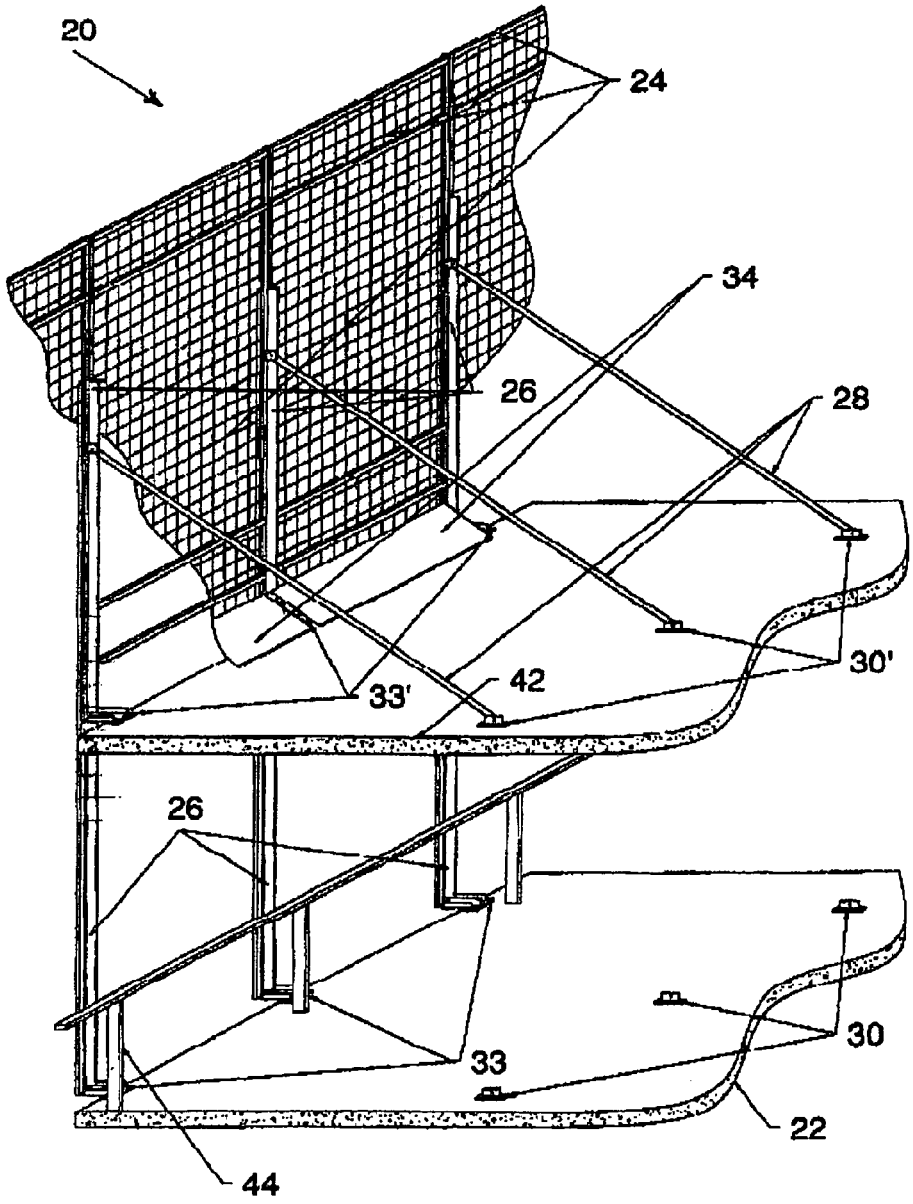
FIG. 6. is a view similar to FIG. 4, showing braces relocated and attached to a superposed floor.

FIG. 6 shows the braces 28 transferred from the floor 22 to the superposed floor 42, the side rails 26 remain supported by multi-brackets 33 on floor 22 and by multi-brackets 33; on floor 42.

Figure 7:
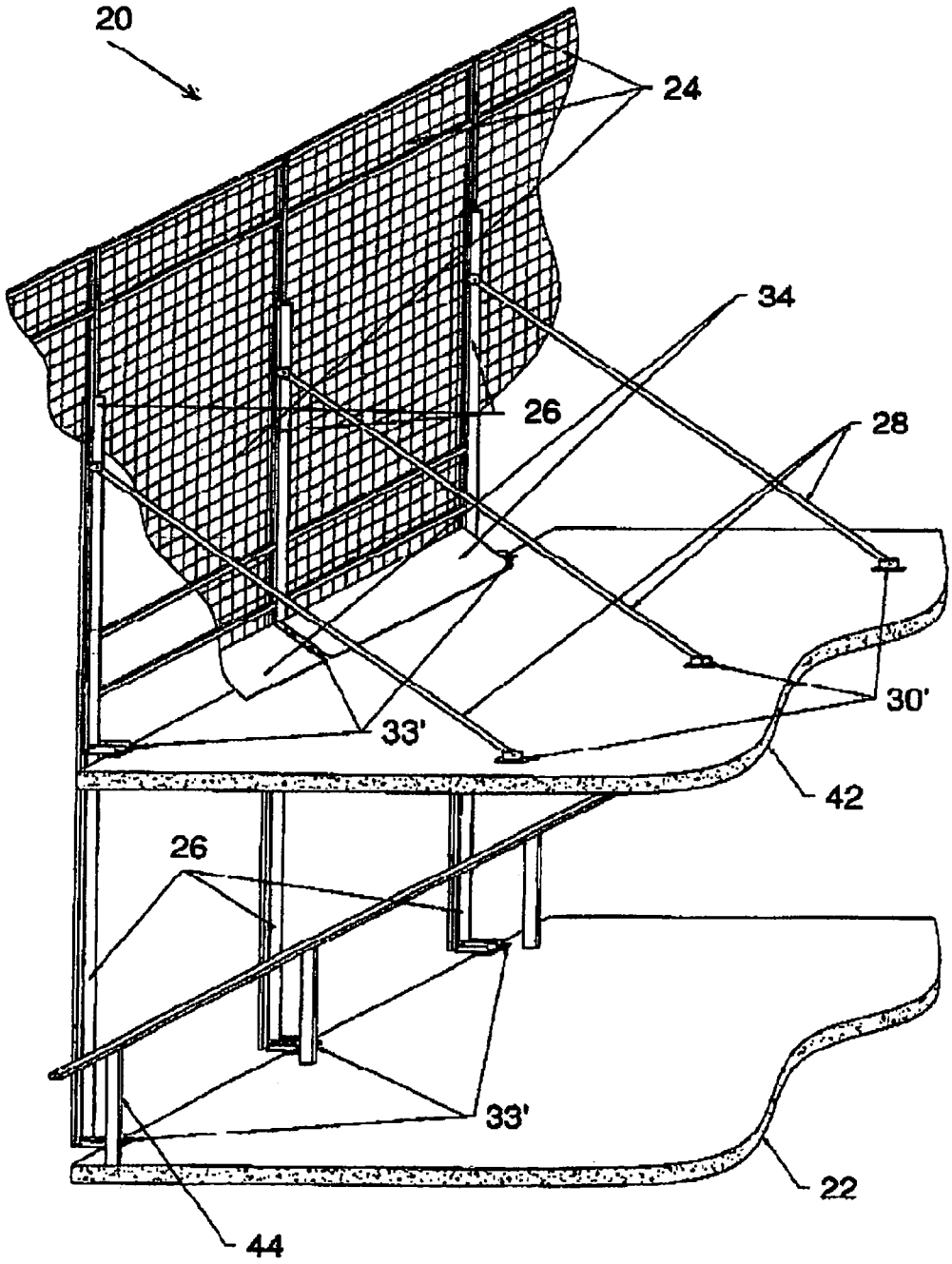
FIG. 7. is a view similar to FIG. 4, showing toe-boards located between the superposed floor and the safety barrier panels.

FIG. 7 shows multi-brackets 33 having been removed from the side rails 26, leaving them supported at their foot by multi-brackets 33; and slidably engaged by the safety barrier panels 24.

Figure 8:
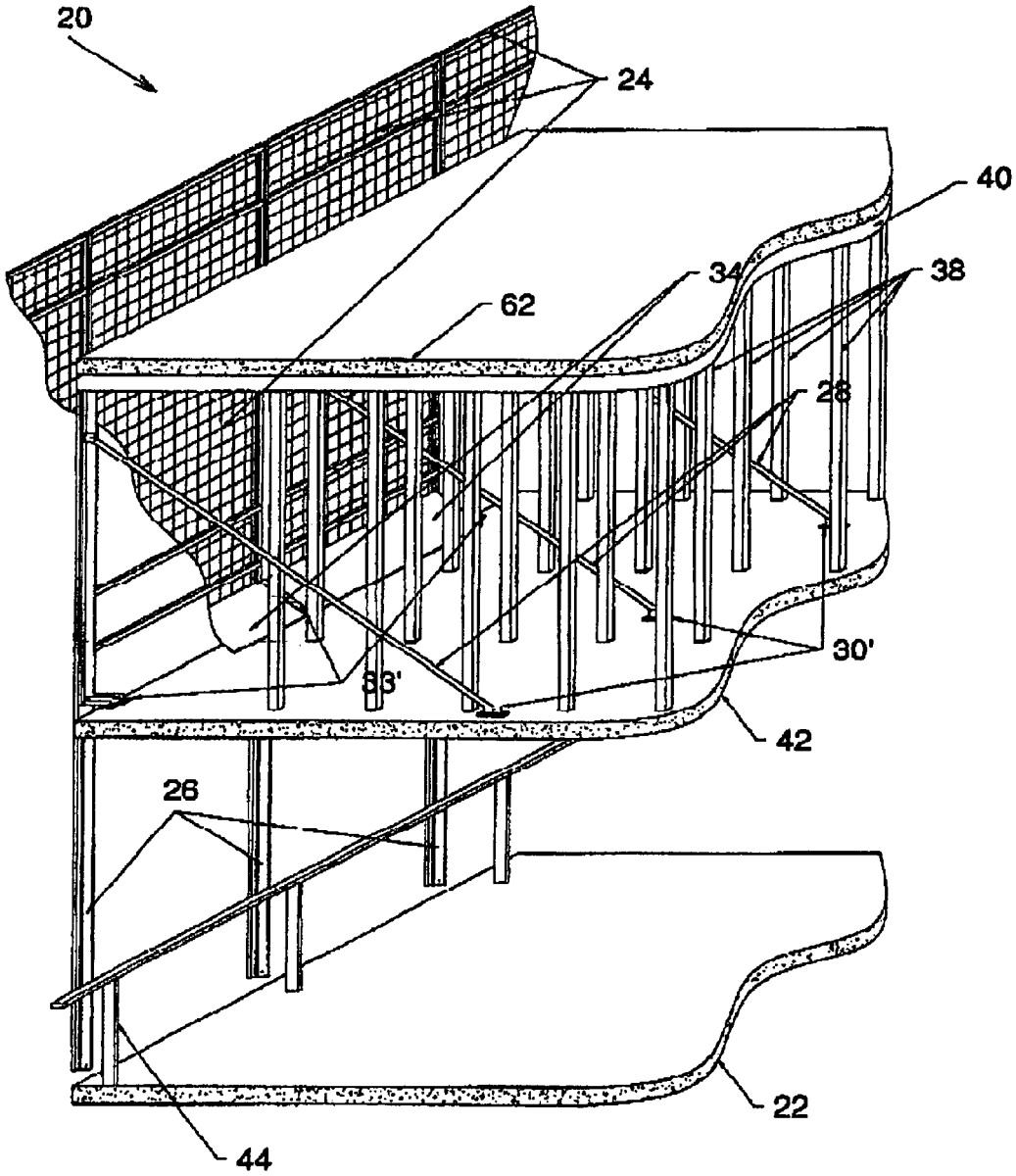
FIG. 8. is a view similar to FIG. 4 showing shoring of a superposed floor.

FIG. 8 shows the reinstallation of the formwork 38, 40, this time upon floor 42, with the next floor 62 poured. This formwork and placement of re-bar and pouring of the floor is carried out within the protective ambit of the repositioned (raised) safety barrier panel 24.

Figure 9:
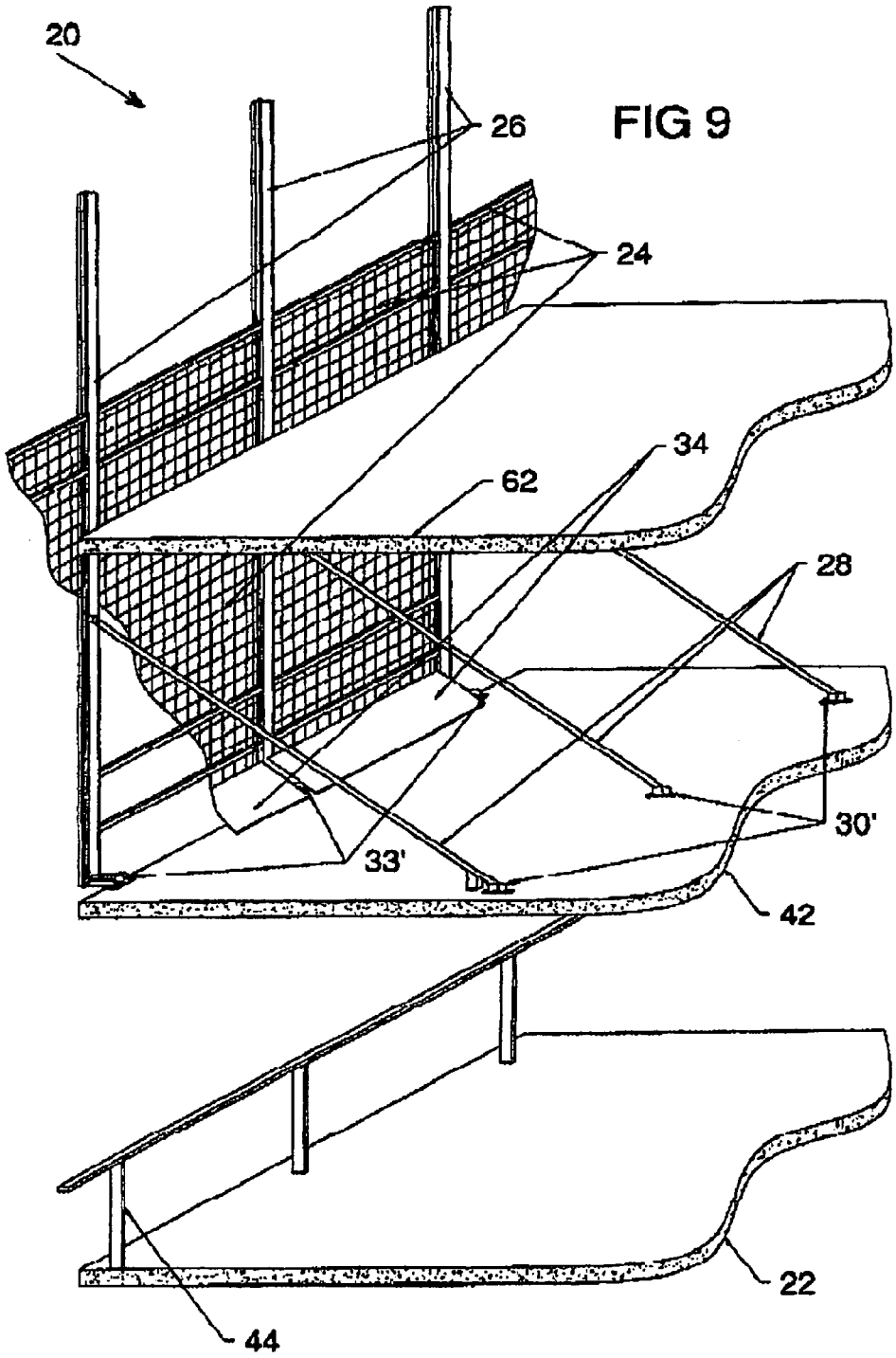
FIG. 9. is a side top perspective showing the relocation of siderails from a completed floor to a superposed floor.

FIG. 9 shows the side rails 26 repositioned to, and supported from floor 42 by multi-brackets 33'. During this upward "stepping" of the system components, the secured safety barrier panels 24 serve as a guide and lateral support for the upward sliding of the side rails 26, as they are raised to their new station at the next level, the floor 42.

In this condition, the safety barrier system 20 is set-up for a repetition of the above-described cycle.

Figure 10:
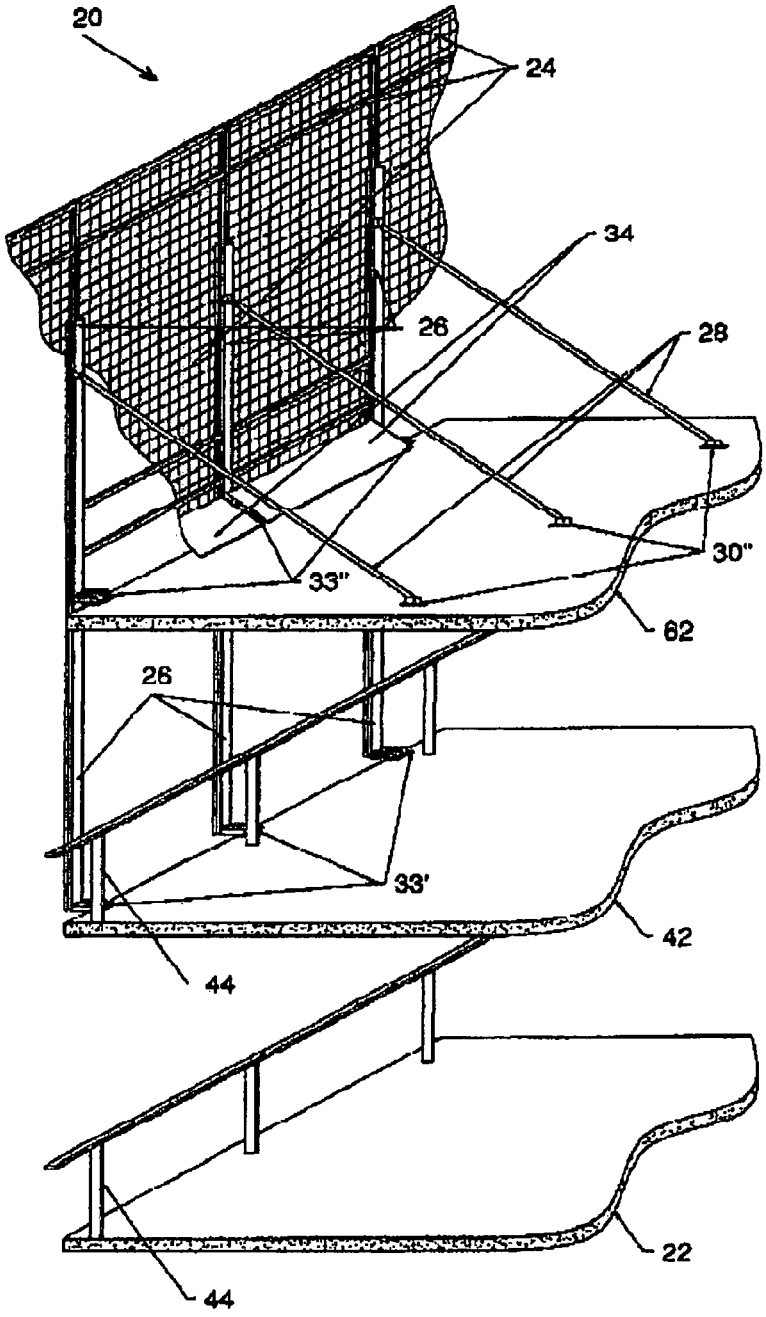
FIG. 10. is a side top perspective showing the upward relocation of braces, toe board and safety barrier panels, and installation of a temporary conventional guard rail.
Figure 11:
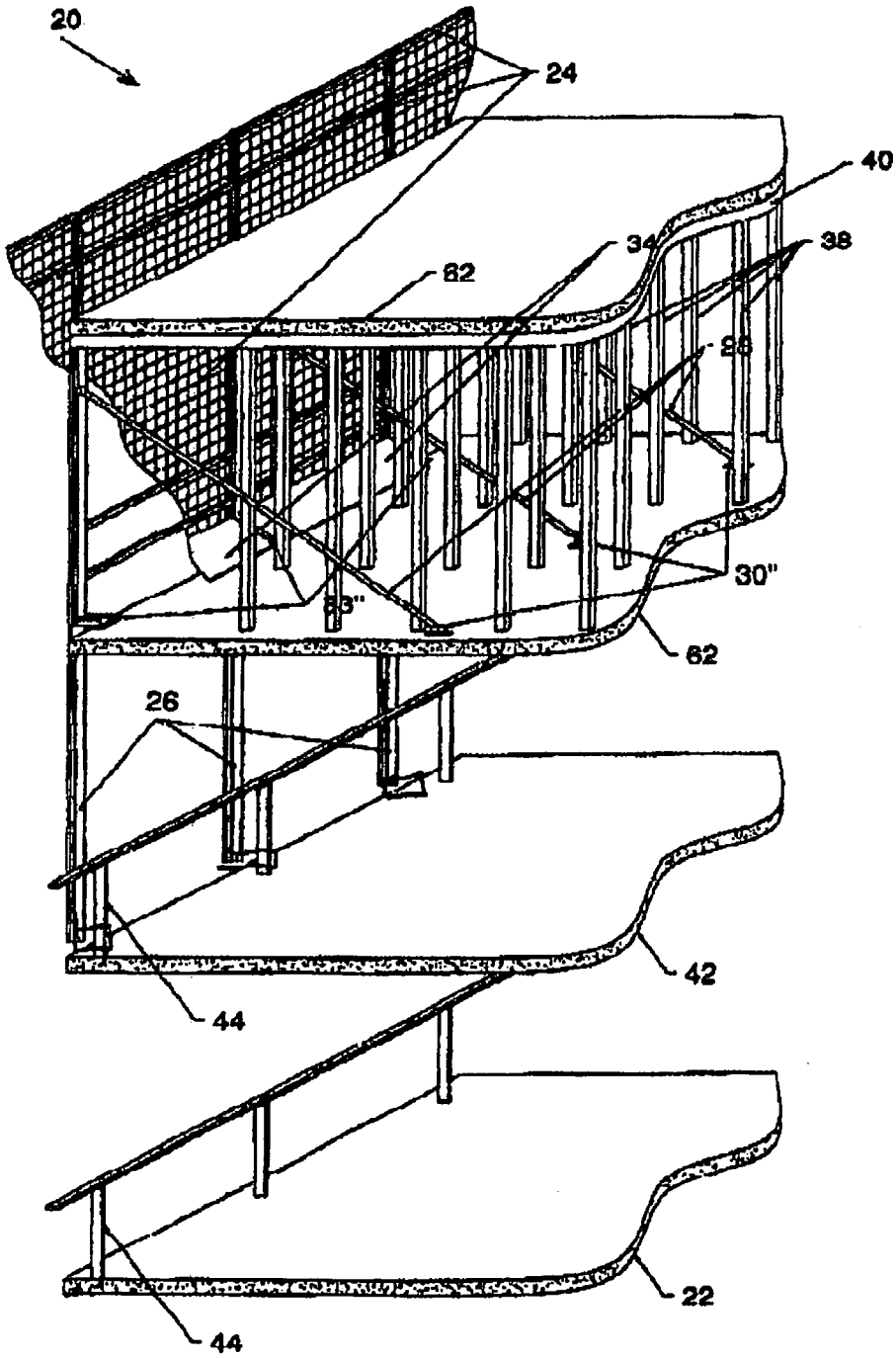
FIG. 11. is side top perspective showing the addition of shoring to a superposed floor.

FIG. 10 is inherently a 'repetition' of FIG. 6, carried out one floor higher; and FIG. 11 is a partial 'repetition' of FIG. 8, with the formwork 38, 40 relocated and reinstalled above the current 'top' floor 62, prior to the actual pouring of the concrete floor into the formwork portion 40. The safety barrier panels 24 are relocated to, and supported at the current top floor 62, along with the braces 28. The side rails 26 extend from, and are secured to the second floor 42.

Figure 11A:
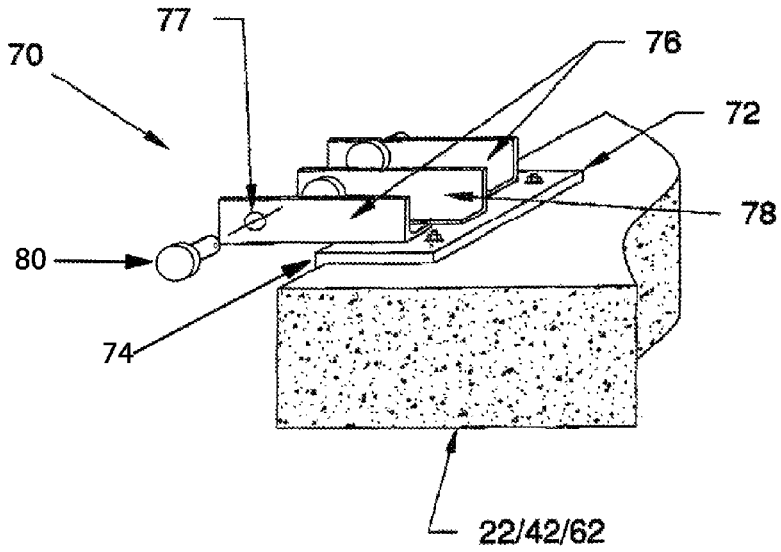
FIG. 11A is a side top perspective of a floor-mounted attachment multibracket.

FIG. 11A shows a preferred multi-bracket embodiment 70. The multi-bracket 70 has a baseplate 72 with a downturned forward lip 74 to engage the edge face of a floor, 22/42/62. Three forwardly projecting bars 76, 76 and 78 (illustrated as angle sections) are sized and positioned to engage respective ribs 27, 27 of mutually adjacent safety barrier panels 24 and rib 29 of the associated duplexed rail 26 (see FIG. 12), by way of bolts or pins 80 inserted through apertures 77. The multi-brackets 70 are secured by capscrews or ragbolts to the respective floor 22, 42, 62 of the structure.

Figure 12:
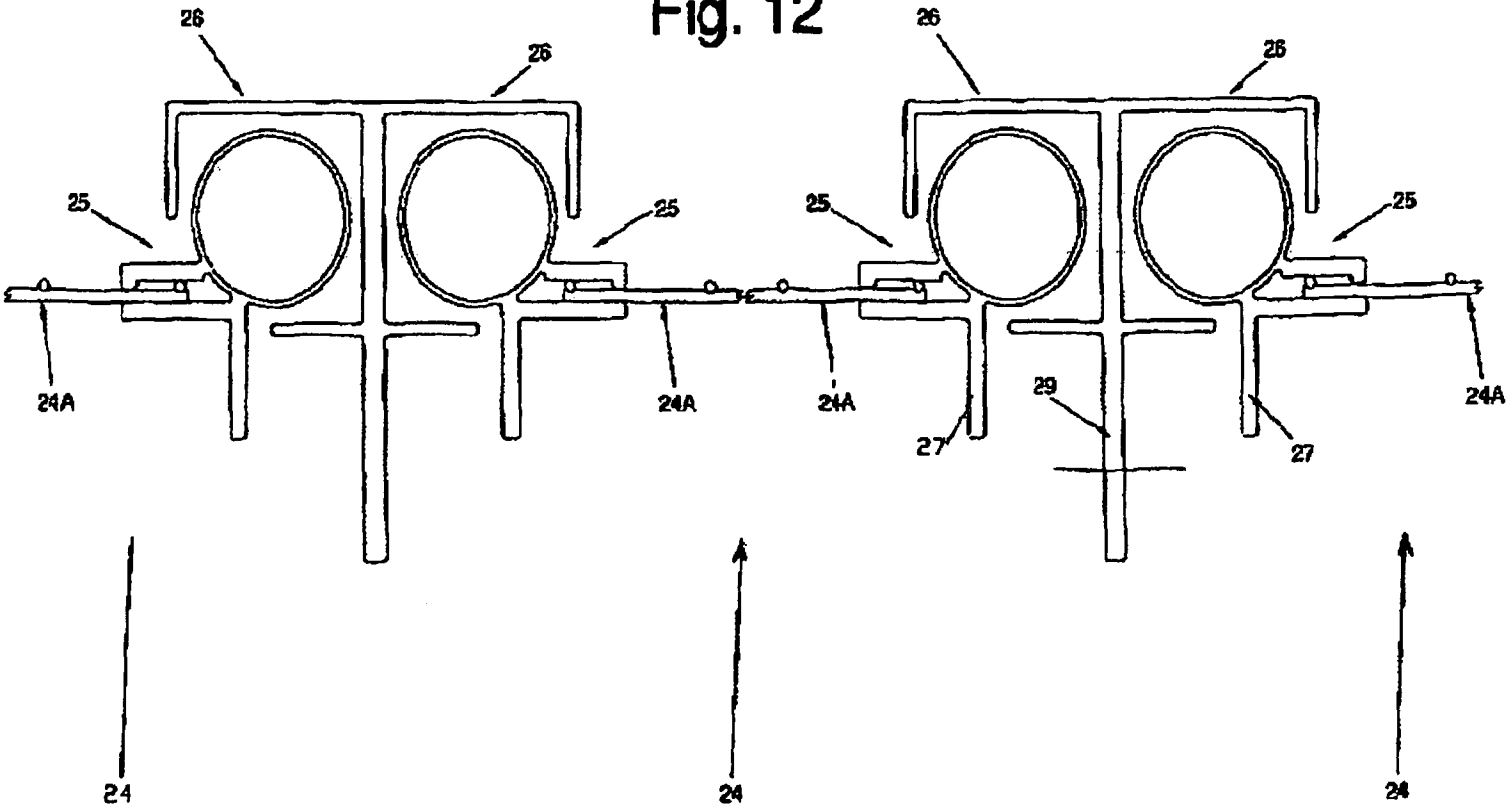
FIG. 12 is a cross sectional view of adjacent safety barrier panels secured between duplex side rails; and, FIG. 13 is a side tip perspective showing a complete safety barrier panel in accordance with the present invention.
Figure 13:
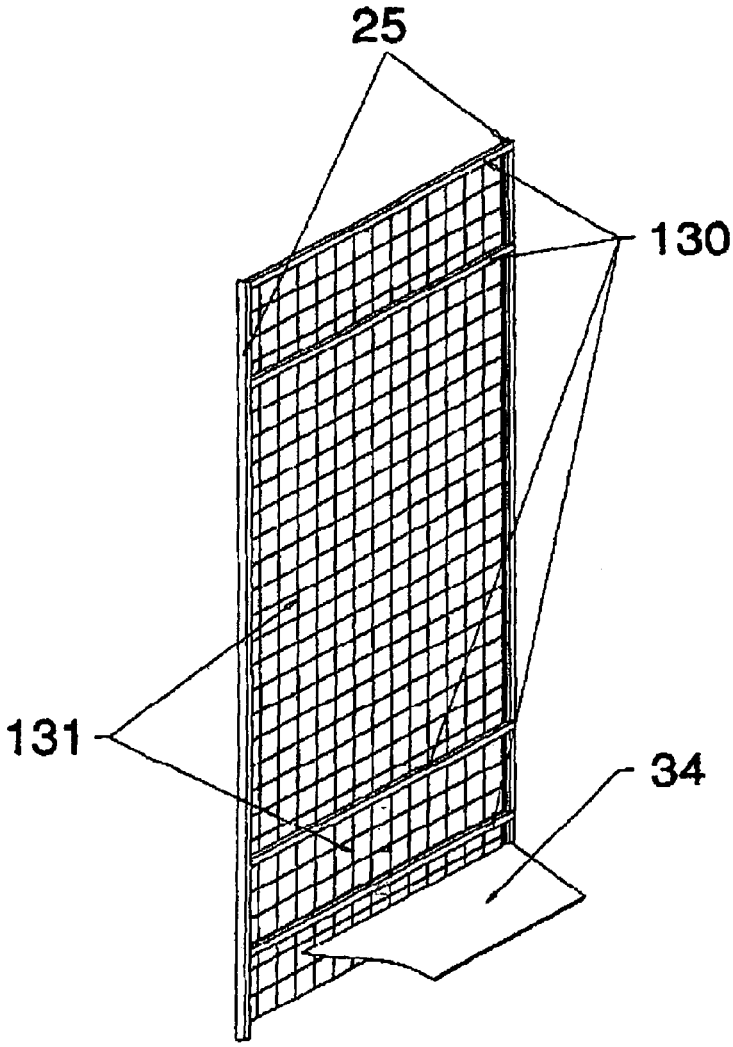

Referring to FIG. 12, this shows the duplex (side by side or 'siamesed') form of the side rails 26. Portions of three safety barrier panels 20, are shown, with two side rails 26 having four of the cylindrical edge portions 25 of three safety barrier panels 24 entered in slidable relation within the twin enclosures of each of the side rails 26. The illustrated mesh portions of safety barrier panels 24 are secured to the respective safety barrier panel edge portions 25.

The duplex form of the side rails 26 enables the independent manipulation of the side rails or the safety barrier panels 24 in carrying out the vertical repositioning or 'walking' of the system relative to the face of a building.

The open ends of the side rails 26 and the flat faces of the ribs 27, 29 facilitate assembly, disassembly and repositioning of the side rails 26 and safety barrier panels 24 in relation to the multi-brackets 70 of the system.

The multi-brackets 70 are fabricated and bolted into position on the respective floor edges, relative to the lateral spacing and location of the ribs 27, 29 of safety barrier panels 24 and side rails 26, so that the flat faces of the ribs 27, 29 are in vertical sliding relation with the flat outer faces of the angle bars 76, 78 of multi-brackets 70. The flanges of angle bars 76, 78 may be relieved at their outer ends to accept the ribs 27, 29 of the safety barrier panels 24 and side rails 26, if so desired.

This construction enables unrestricted vertical repositioning of the safety barrier panels 24 and side rails 26 relative to the floor-mounted multi-brackets 70. The multi-brackets 70 can then be selectively pinned in supporting relation to the safety barrier panels 24 and side rails 26 at intermediate locations along their length, in the manner indicated in FIGS. 4 through 8, 10 and 11.

It will be understood that the multi-bracket 70 embodiment serves the functions provided nose brackets 33 and 31' and 33", disclosed above.

We claim:

1. A method for providing a perimeter safety barrier to a face of a structure during floor by floor construction, comprising the steps of:

in any order, erecting a series of mutually adjacent safety barrier panels in supported relation at an edge of a first floor and securing both horizontally and vertically said safety barrier panels directly to said first floor using one or more first floor brackets, laterally linking said panels in mutual sliding relation with interposed side rails and securing both horizontally and vertically said side rails directly to said first floor using the one or more first floor brackets, said safety barrier panels being connected to said first floor independently of said side rails;

said safety barrier panels and said side rails cooperatively reinforce each other and extend upward in cantilevered relation to project above the working level of a superposed second floor, said side rails and safety barrier panels thus serving as said perimeter safety barrier to said second floor working level, during construction of said second floor; and progressively elevating said side rails in sliding relation with said safety barrier panels into upwardly projecting, cantilevered relation, said side rails being supported by said safety barrier panels, said safety barrier remaining secured directly to said first floor using one or more first floor brackets while elevating said side rails;

securing both horizontally and vertically said side rails directly to said second floor using one or more second floor brackets, progressively elevating said safety barrier panels in sliding relation with said side rails into upwardly projecting, cantilevered relation, said safety barrier panels being supported by said side rails, and securing both horizontally and vertically said safety barrier panels directly to said second floor using the one or more second floor brackets, whereby said safety barrier panels are raised piecemeal up the face of said structure, in mutually connected sliding relation with said side rails, in protective relation with said second superposed floor, and project above a third superposed working level so as to form an upwardly projecting cantilevered safety barrier at said third superposed working level, wherein the first floor brackets and second floor brackets each comprise one or more projecting bars fastened to a base plate, each of the one or more projecting bars having an aperture cooperative with a pin, the pin releasably engaging with apertures in one or more ribs on said safety barrier and one or more ribs on said side rails.

2. The method as set forth in claim 1, including the step of further securing both horizontally and vertically said side rails to said structure, extending upward in cantilevered relation above said third floor.

3. The method as set forth in claim 2, wherein said further side rail securing step is carried out using securing devices selected from the group consisting of braces and multi-brackets.

4. The method as set forth in claim 1, wherein said progressive relocation of said safety barrier is effected by elevating said safety barrier panels and said side rails piecemeal, from one said floor to a higher said floor, wherein said safety barrier panels and said side rails cooperatively reinforcing each other in guided sliding relation during said relocation.

5. The method as set forth in claim 4, wherein said elevating step is selected from the group consisting of manual elevation and mechanical hoisting.

6. The method as set forth in claim 3, comprising the step of after pouring said first floor, securing lower ends of said side rails and said safety barrier panels to said first floor and affixing inclined braces between said safety barrier and said first floor, to retain said safety barrier in an erect orientation while said superposed second floor is constructed.

7. The method as set forth in claim 1, comprising the step of securing a toe board between the safety barrier panel and the edge of each said floor.

* * * * *

UNITED STATES PATENT AND TRADEMARK OFFICE

CERTIFICATE OF CORRECTION

PATENT NO. : 8,511,039 B2
APPLICATION NO. : 11/247377
DATED : August 20, 2013
INVENTOR(S) : Dougall et al.

It is certified that error appears in the above-identified patent and that said Letters Patent is hereby corrected as shown below:

On the title page, Column 1, item (76), Line 2, should read --Markus Jaan Hess--

Signed and Sealed this
Twenty-second Day of October, 2013

Teresa Stanek Rea
*Deputy Director of the United States Patent and Trademark Office*